United States Patent [19]

Minoru

[11] Patent Number: 4,715,475

[45] Date of Patent: Dec. 29, 1987

[54] TWO-SPEED DRIVE MECHANISM FOR TOYS

[76] Inventor: Ishida Minoru, 8-302, Ikenohata 4-Chome 8, Taito-ku, Tokyo, Japan

[21] Appl. No.: 884,901

[22] Filed: Jul. 14, 1986

[30] Foreign Application Priority Data

Nov. 30, 1985 [JP] Japan ..... 60-184659[U]

[51] Int. Cl.[4] ..... F03G 1/08; A63H 29/04; A63H 31/00

[52] U.S. Cl. ..... 185/39; 185/38; 185/DIG. 1; 446/464

[58] Field of Search ..... 185/37, 38, 39, DIG. 1; 446/464

[56] References Cited

U.S. PATENT DOCUMENTS

| | | | |
|---|---|---|---|
| 1,418,657 | 6/1922 | Kucharski | 185/38 |
| 2,735,222 | 2/1956 | Glass | 185/38 X |
| 3,732,949 | 5/1973 | Williams | 446/464 X |
| 4,463,831 | 8/1984 | Wakase | 185/DIG. 1 X |
| 4,469,197 | 9/1984 | Minoru | 185/45 |
| 4,478,313 | 10/1984 | Wakase | 185/DIG. 1 X |
| 4,568,308 | 2/1986 | Itoh | 185/DIG. 1 |

*Primary Examiner*—Allan D. Herrmann
*Attorney, Agent, or Firm*—Holman & Stern

[57] ABSTRACT

The two-speed drive mechanism for toys of the present invention comprises, in order to utilize the spiral spring releasing force as the source of driving power, a mechanism element interconnecting through a gear mechanism a spiral spring shaft fixed with one end of the spiral spring and an output shaft for taking out the power; a mechanism element for deciding to change or not to change the rotational speed by acting or not acting on the output shaft of the aforementioned mechanism element; and an interconnecting gear group for interconnecting the spiral spring shaft and the aforementioned elements so that the working time of the latter mechanism element may be effected later by certain rotations than the point of time the spiral spring begins to rotate (when releasing).

2 Claims, 4 Drawing Figures

(WIND UP)

(WIND OFF)

TWO-SPEED DRIVE MECHANISM FOR TOYS

BACKGROUND OF THE INVENTION

This invention relates to a two-speed drive mechanism adapted for use as a power source for toys, in particular for toy automobiles and the like.

DESCRIPTION OF PRIOR ART

For drive mechanisms for toys using a spiral spring there is known a pull-back spiral spring device, that is, a device in which the toy wheels are reversely rotated by being rubbed against a floor or the like to wind the spiral spring to store the power which is to be used for rotating the wheels for running toys. Reference is made to U.S. Pat. No. 4,469,197.

In such a device, however, the power released by the spiral spring is transmitted directly to the wheels so that the toy automobiles provided with such a device run merely monotonously at a uniform speed.

SUMMARY OF THE INVENTION

An object of this invention is to provide a two-speed drive mechanism for toys using a spiral spring capable of changing the speed at two stages.

It is another object of the present invention to provide a two-speed drive mechanism for toys comprising a power device of a uniform rotation speed provided with a gear mechanism for interconnecting a spiral spring shaft fixed with one end of the spiral spring and an output shaft rotatable for driving the spiral spring and being rotated by release of the spiral spring force and also additionally attached with a speed change gear mechanism capable of changing the speed at two stages.

The above-mentioned object is attained in the two-speed drive mechanism for toys characterized in that in the two-speed drive mechanism for toys provided with the gear mechanism for interconnecting the output shaft and the spiral spring shaft with one end of the spiral spring fixed thereto a cam is provided so as to interlock and rotate with the spiral spring shaft through a group of gears, an intermediate member being provided having intermediate gears for interlocking with the cam to engage and change the position in the same direction therewith as when the recess part of the cam moves upwardly from below through winding up of the spiral spring to interconnect the gear on the output shaft with a low-speed gear, an anchor being provided to swayingly engage with a gear coaxial with the low-speed gear to feed tooth by tooth, a projection being provided on the cam to contact with the intermediate member from below to keep its position when the intermediate member is on the low-speed side, a ratchet mechanism being further incorporated in the aforementioned group of interconnecting gears to prevent the spiral spring winding up force from being transferred further beyond the cam in that state, and being designed that when the cam moves downwardly from above by means of release of the spiral spring the rotation speed of the output shaft is changed before and after the recess part of the cam engages with the intermediate member to change its position reversely to that of the aforementioned.

BRIEF DESCRIPTION OF THE DRAWINGS

The accompanying drawings show one preferred embodiment of the two-speed drive mechanism for toys according to this invention, wherein.

DETAILED DESCRIPTION

Figure 1:
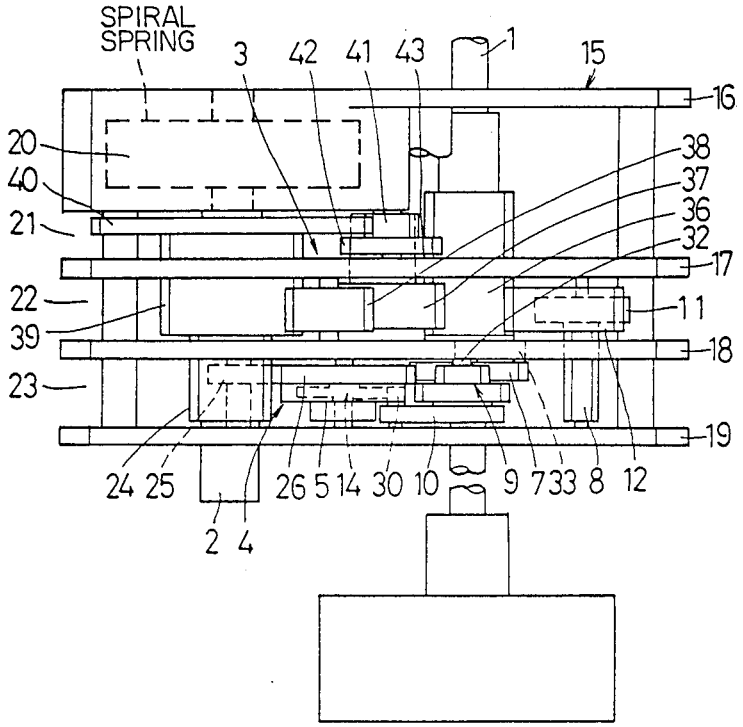
FIG. 1 is a top diagrammatic plan view of the mechanism of the present invention.
Figure 2:
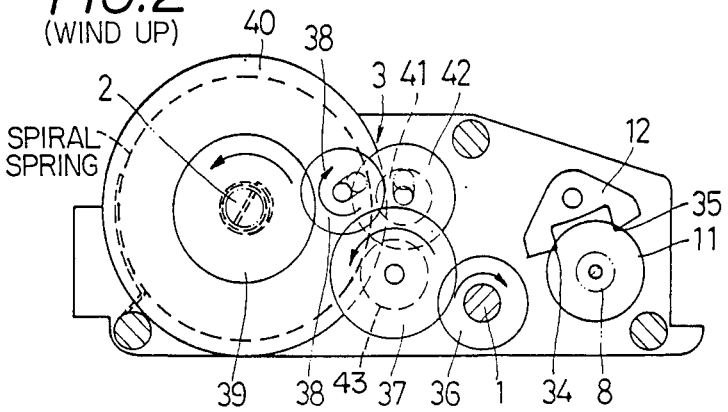
FIG. 2 is a side elevation of the second chamber of the frame.

Referring now to the embodiment shown in the drawings, an output shaft 1 is disposed in the lower part of a frame 15 so as to be interconnected with a spiral spring shaft 2 through a gear mechanism 3 for driving as described later herein, the spiral spring shaft 2 being disposed in the upper part of the frame 15.

The frame 15 is provided with partitions 16, 17, 18 and 19 (FIG. 1) and the spaces among them are separated into three chambers 21, 22 and 23, and in the first chamber 21 there is a spiral spring containing chamber 20.

The spiral spring shaft 2 has a small gear 24 projecting into the third chamber 23 and is arranged to drive a cam gear 26 coaxial with a cam 5 through a gear 25 engaging the small gear 24, these gears 24, 25 and 26 forming an interconnecting gear group 4 for rotating the cam 5.

Figure 4:
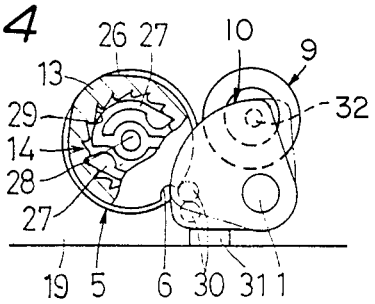
FIG. 4 is a view showing one main part of the mechanism of this invention.

A ratchet mechanism 14 is provided between the cam 5 and the cam gear 26 (FIG. 4) and comprised of an S-shaped latch arm 27 integral with the gear 26 and an internal gear 29 formed on the opposing surface of the cam 5 inserted over a shaft 28 wherein only the cam gear 26 rotates idly after the cam 5 has been stopped by the ratchet mechanism.

Numeral 30 is an engaging projection provided at the cam side end of an intermediate member 10 formed in sector and at the other end of the intermediate member there is pivotally mounted an intermediate gear 9 consisting of a large gear **9*a* and a small gear 9*b*. The intermediate member 10 itself is idly journalled on the output shaft 1 so as to swing in the direction away from the cam be engagement of projection 30 with a cam recess 6 and to freely move back in the cam direction through the rotation of the output shaft 1 when it advances by disengaging of projections 12 and 30**.

Figure 3:
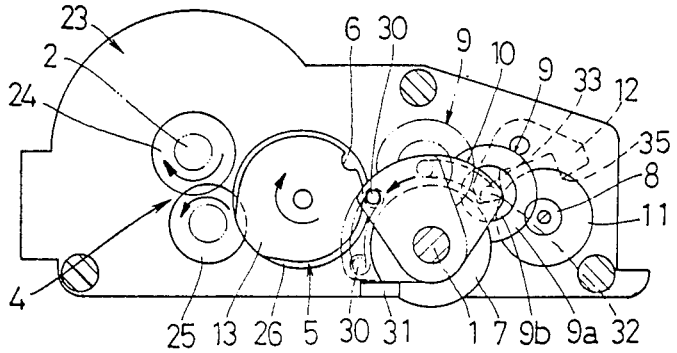
FIG. 3 is similarly a side view of the third chamber of the frame.

Numeral 31 indicates an abutment piece to abut the intermediate member 10. When the spiral spring is wound up the cam 5 makes a counter-clockwise rotation as in FIG. 3 and when it moves upwardly the cam recess 6 engages with the engagement projection 30, and in that state making a further counter-clockwise rotation so that the larger gear 9a of the intermediate gear 9 may engage with a low-speed gear 8 and such a state can be kept supported by a cam projection 13 supporting the engagement projection 30 from below.

The smaller gear **9*b* of the intermediate gear 9 is in constant engagement with the gear 7 of the output shaft 1. Numeral 32 is an intermediate gear shaft; 33 is its arc bearing formed within the third partition 18. Gear 11 coaxial with the low-speed gear 8 is disposed in the second chamber 22 and is fed tooth after tooth by projections 34, 35 of an anchor 12** pivoted thereon in the manner of an escapement mechanism.

The gear mechanism 3 between the output shaft 1 and the spiral spring shaft 2 is disposed in the first and second chambers and has a winding up system comsisting of a pinion 36 integral with the output shaft 1, gear 37, idle gear 38, and middle gear 39 of the spiral spring shaft 2, all these gears being arranged to interengage successively, and an output system consisting of an idle gear 41 designed to engage only when the larger gear 40 of the spiral spring shaft 1 rotates through the release of the spiral spring, a gear 42 coaxial with the idle gear 41, and a gear 43 arranged to engage therewith and coaxial with the gear 37.

Thus when winding up, each of the gears 36, 37, 38 and 39 engages in cooperation to rotate the spiral spring shaft 2 to wind up the spiral spring in the chamber 20; and when releasing the spring, the gears 40, 41, 42, 43, 37 and 36 engage in cooperation to rotate the output shaft 1 (gear 38 being idle) and this rotation is subjected to speed control through the engagement of the aforementioned intermediate gear 9 and the low-speed gear 8.

Since the gear 7 of the output shaft 1 and the low-speed gear 8 engages with each other through the intermediation of the gear 9 it becomes possible to provide two-stage speed change by loading and unloading the output shaft 1 which is driven by the releasing force of the spiral spring as explained below.

The intermediate gear 9 engages with and disengages from the aforementioned gear 8 by means of the intermediate member 10 swaying and changing its position and since the action of the gear 9 is controlled by the rotation of the cam 5 which is driven by the releasing rotation of the spiral spring shaft 2 through the ratchet mechanism 14 the gear 9 may shift to a high-speed rotation substantially after a constant low-speed rotation. Also, since the winding up force of the spiral spring is not transmittable after the rotation of the cam 5 has been stopped by the ratchet mechanism 14 the spiral spring may sufficiently be wound up so that any breakage or failure of the gears etc. may be avoided.

Since the present invention is constructed as described above it has the advantage of changing the rotational speed of the output shaft 1 in two stages in that the intermediate member 10 may be set on the low-speed gear side 8 by winding up the spiral spring and the intermediate member 10 may be removed by means of the recess 6 of the cam 5 rotated by the spiral spring shaft 2 and the switching of its speed may be controlled by the cam 5 and the intermediate member 10 interengaged through the spiral spring shaft 2 and the interconnecting gear group 4. The operation of the mechanism is therefore sure and steady and the movement of the intermediate member 10 is simple.

Speed change mechanisms in general may be provided with a different mechanism such as for sliding gears and therefore problems of irregularities and/or malfunction tend often to arise therein. According to the present invention, however, the construction is different and the speed change may be effected in all by rotation or partial pivotal movement so that the function is always sure and correct and it has the advantage of obtaining variable movements.

What is claimed is:

1. In a two-speed drive mechanism for toys said mechanism being provided with a gear mechanism interconnecting an output shaft and a spiral spring shaft fixed with one end of a spiral spring, a cam having a recess part is provided so as to be engaged with said spiral spring shaft and rotated through a group of interconnecting gears, an intermediate member being provided to interlock with said cam and engage therewith and change its position in the same direction as when the recess part of said cam moves upwardly from below through the winding up of said spiral spring, said intermediate member having an intermediate gear to interconnect the gear on said output shaft and a low-speed gear, an anchor being provided to swayingly engage with an gear coaxial with said low-speed gear and to rotate said gear tooth by tooth, said cam having a projection for contacting said intermediate member from below to keep the position of said intermediate member when it is on the low-speed side, and furthermore, in order to prevent said spiral spring winding up force from being transmitted further beyond said cam in that state a ratchet mechanism being incorporated in said group of interconnecting gears so that the rotational speed of said output shaft may be varied at the time before and after said cam changes its position reversely to its previous position when said cam moves downwardly from above by the release of said spiral spring and said recess part of said cam engages with said intermediate member.

2. The two-speed drive mechanism for toys as claimed in claim 1 wherein said intermediate member is idly inserted over said output shaft.

* * * * *